US005841109A

United States Patent [19]

White et al.

[11] Patent Number: 5,841,109

[45] Date of Patent: Nov. 24, 1998

[54] GLASS SUPPORTED HEATING ELEMENTS FOR RADIANT COOKTOP RANGES

[75] Inventors: James Aaron White, Louisville; Jeffery Donald Hunt, Shelbyville, both of Ky.; Martin Edward Vink, Jr., Dalton, Ga.

[73] Assignee: General Electric Company, Louisville, Ky.

[21] Appl. No.: 833,491

[22] Filed: Apr. 7, 1997

[51] Int. Cl.[6] ..... H05B 3/68

[52] U.S. Cl. ..... 219/464; 219/463

[58] Field of Search ..... 219/458, 463, 219/464, 465, 466, 467; 126/211, 214 A, 212, 220, 92 A, 39 H, 39 B

[56] References Cited

U.S. PATENT DOCUMENTS

| | | | |
|---|---|---|---|
| 2,727,133 | 12/1955 | Scofield | 219/464 |
| 3,613,177 | 10/1971 | Davis . | |
| 3,632,983 | 1/1972 | Dills . | |
| 3,674,983 | 7/1972 | Hurko et al. | 219/464 |
| 3,789,189 | 1/1974 | Fischer et al. . | |
| 3,987,275 | 10/1976 | Hurko . | |
| 4,032,750 | 6/1977 | Hurko . | |
| 4,150,280 | 4/1979 | Hurko . | |
| 4,264,805 | 4/1981 | Traut . | |
| 4,363,956 | 12/1982 | Scheidler et al. . | |
| 4,453,533 | 6/1984 | Scheidler et al. | 219/464 |
| 4,778,978 | 10/1988 | Schreder et al. . | |
| 4,788,414 | 11/1988 | Schreder . | |
| 4,900,899 | 2/1990 | Schreder et al. . | |
| 5,429,114 | 7/1995 | Taplan et al. | 219/464 |

*Primary Examiner*—Teresa J. Walberg
*Assistant Examiner*—Sam Paik
*Attorney, Agent, or Firm*—H. Neil Houser

[57] ABSTRACT

Ranges which include mounting systems for securing the heating elements so that the heating elements are maintained against an underside surface of the glass panel with a substantially constant force over a broad temperature range are described. In one embodiment, the cooktop includes a frame having an opening for receiving the glass panel. Flanges extend into the opening from the frame and support the panel in the opening. A metal plate is secured to an underside surface of the glass panel, and the plate includes a plurality of radiant heating element openings. The mounting system includes coil springs, or other types of springs, for engaging to the plate and to the radiant heating elements for positioning the radiant heating elements within the radiant heating element openings and against the glass panel. Various alternative embodiments of the above described mounting system are also described.

13 Claims, 2 Drawing Sheets

GLASS SUPPORTED HEATING ELEMENTS FOR RADIANT COOKTOP RANGES

FIELD OF THE INVENTION

This invention relates generally to ranges including radiant cooktop heating elements and, more particularly, to a mounting system for supporting the heating elements.

BACKGROUND OF THE INVENTION

In at least some known radiant cooktop ranges, the heating elements are secured to the cooktop below a cooktop glass panel. The heating elements are held against the cooktop glass panel by a mounting assembly including a bracket secured to the range cabinet and a brace which extends the width of the cooktop. The heating elements are mounted to the brace by a compression coil spring and stud assembly. The compression coil spring and stud assembly provides that the heating elements are forced against the cooktop glass panel with a desired force so that heat from the heater elements is efficiently transferred through the glass panel. In operation, as the heating element heats up, the heat is transferred through the cooktop glass panel to, for example, a cooking bowl located over the heating element on the glass panel.

Although the known mounting assembly described above adequately locates and supports the radiant heating elements, such assembly includes numerous parts and is complex to assemble. As a result, assembling the heating elements in the range is time consuming and tedious, which is particularly undesirable in a high volume manufacturing operation.

In addition, and to assemble the mounting assembly described above, tools are used for mounting the bracket to the cooktop, securing the braces to the bracket, and engaging the spring and stud assemblies to the braces and heating elements. The cooktop glass panel, however, is susceptible to scratching, and when using the tools for assembling the mounting assembly, there is a possibility that the glass panel will be scratched by a tool. Of course, scratching the glass panel is highly undesirable since such a scratched plate typically is discarded.

It would be desirable to provide a mounting system for mounting heating elements to cooktops so that over a wide range of operating temperatures, the heating elements are forced against the cooktop glass panel with a desired force, e.g., fourteen pounds. In addition, it would be desirable for such a system to have a reduced number of parts as compared to known mounting assemblies and be simple to assemble. Further, it would be desirable to substantially eliminate a need for the use of tools to secure the heating element to the cooktop so as to facilitate avoiding scratching the glass cooktop.

SUMMARY OF THE INVENTION

These and other objects may be attained in a range which includes a mounting system for securing the heating element to the range so that the heating element is maintained against an underside surface of the glass panel with a substantially constant force over a broad temperature range. Various alternative embodiments of the invention are described herein. In one specific embodiment, the cooktop includes a frame having an opening for receiving a glass panel. Flanges extend into the opening from the frame and support the glass panel in the opening. A metal plate is secured to the underside surface of the glass panel, and the plate includes a plurality of radiant heating element openings. The mounting system includes coil springs for engaging to the plate and to the radiant heating elements for positioning the radiant heating elements within the radiant heating element openings and against the glass panel.

More particularly, and for each heating element opening, a rim extends from an underside surface of the plate and surrounds the radiant heating element opening. The rim includes a first slot and a second slot, and the first and second slots are located approximately about one hundred and eighty degrees apart in the rim. The first coil spring has a spring hook portion at least partially inserted into the first rim slot, and the second coil spring includes a spring hook portion at least partially inserted into the second rim slot. Each coil spring also includes a lead-in portion for engaging to the heating element. Specifically, the coil spring lead-in portion can be inserting into an opening in the heating element.

To install the coil springs, each spring is positioned so that the respective spring hooks extends through respective rim slots. Each spring is then oriented so that its lead-in portion is inserted into the opening in the heating element. The spring coils exert an upward force on the heating element so that the heating element is forced against the glass panel with the desired force.

Various alternative embodiments of the above described mounting system are possible. For example, rather than the securing the metal plate to the glass panel, separate brackets adhesively secured to the glass panel can be used to support the heating elements. The brackets can be fabricated separate from the heating elements, or the brackets can be integral with the heating elements and fabricated as components of such elements. Various alternatives are described hereinafter in more detail.

The above described mounting systems secure the heating elements within the range by utilizing the glass panel for stability and support. The added stability and support provided by the glass panel facilitates maintaining the heating elements against the panel with a desired force, e.g., fourteen pounds.

In addition, the systems have a reduced number of parts as compared to known mounting assemblies and are simple to assemble. Further, the systems substantially eliminate a need for the use of tools to secure the heating elements so as to facilitate avoiding scratching the glass panel.

DETAILED DESCRIPTION OF THE DRAWINGS

Figure 1:
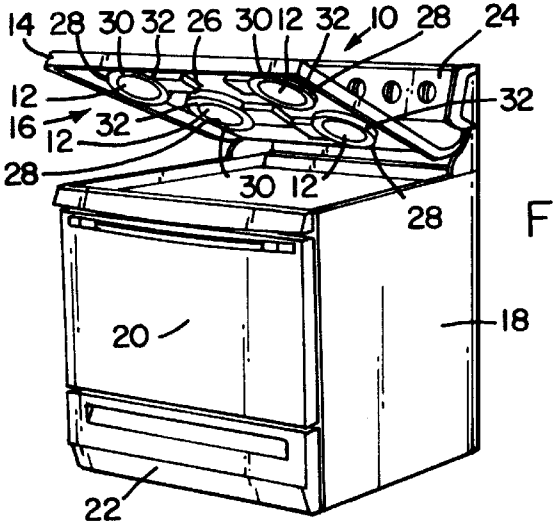
FIG. 1 is a perspective view of a range including radiant heating elements and a mounting system in accordance with one embodiment of the present invention.

FIG. 1 is a perspective view of a radiant cooktop range 10 including heating elements 12 secured to a cooktop 14 by a mounting system 16 in accordance with one embodiment of the present invention. Range 10 includes a cabinet 18, a door 20 closing an open end of a cooking cavity (not shown) and secured (e.g., by hinges) to cabinet 18, and a lower drawer 22. Range 10 further includes a backsplash 24 extending from cabinet 18.

As described hereinafter in more detail, mounting system 16, in one embodiment, includes a plate 26 having a plurality of openings 28 for receiving radiant heating elements 12. A plurality of coil springs 30, or other type of springs, are secured to rims 32 which extend from an underside of plate 26 at the location of openings 28, and each rim 32 substantially surrounds a respective one of openings 28. For each rim 32, springs 30 are secured approximately about one hundred and eighty degrees apart to rim 32 and support heating element 12.

Mounting system 16 can be utilized in many different model ranges and is not limited to use in any one particular range. Range 10 is illustrated here by way of example only. Ranges 10 are well known and are commercially available from General Electric Company, Appliance Park, Louisville, Ky. 40225.

Figure 2:
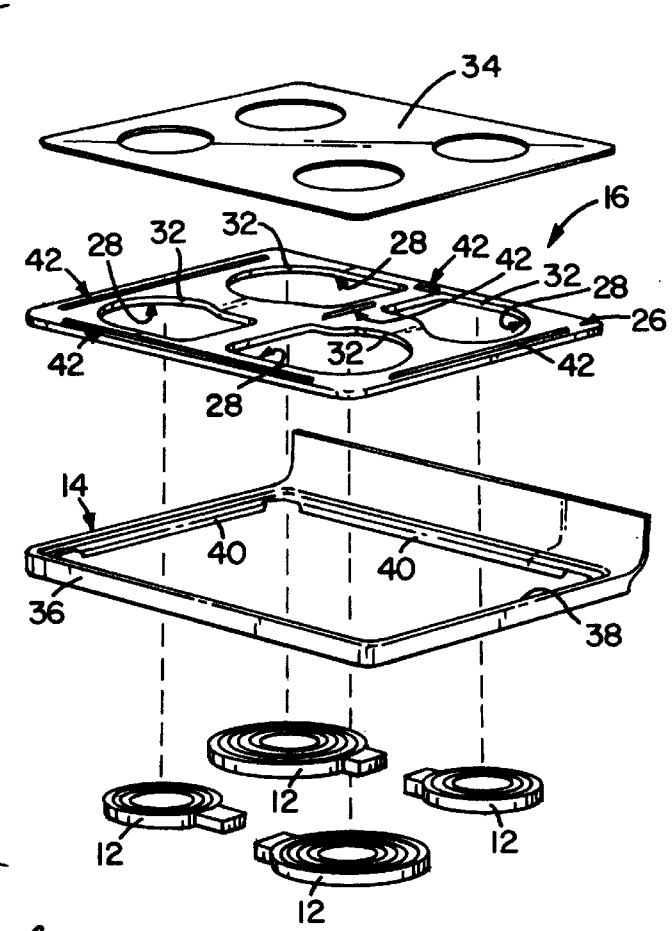
FIG. 2 is an exploded view of the cooktop and heating element assembly shown in FIG. 1.

FIG. 2 is an exploded view of a glass panel 34, cooktop 14 and mounting assembly 16. As shown in FIG. 2, cooktop 14 includes a frame 36 having an opening 38 for receiving panel 34. Frame flanges 40 extend into opening 38 and support panel 34. Plate 26 is adhesively secured to glass panel 34 at selected locations 42, and plate 26 includes a plurality of radiant heating element openings 30. Plate 26 can be secured to panel 34 using, for example, a silicone adhesive or other adhesive material.

Figure 3:
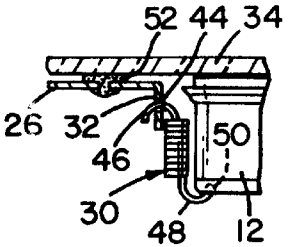
FIG. 3 is an enlarge, partial cross sectional view illustrating the coil spring for securing the heating element to the glass panel.

FIG. 3 is an enlarged, partial cross sectional view illustrating one coil spring 30 securing heating element 12 against glass panel 34. Particularly, rim 32 includes slot 44. Another slot (not shown) is located approximately about one hundred and eighty degrees apart in rim 32. Coil spring 30 has a spring hook portion 46 at least partially inserted into rim slot and a lead-in portion 48 engages to heating element 12. Specifically, coil spring lead-in portion 48 is inserted into an opening 50 in heating element 12. Typically, two coil springs 30 are utilized to secure each heating element 12, although more springs 30 could be used, if desired.

To install coil springs 30, each spring 30 is positioned so that its respective spring hook 46 extends through one of respective rim slots 44. Spring 30 is then oriented so that its lead-in portion 48 is inserted into one of openings 50 in heating element 12. Spring coil 30 exerts an upward force on heating element 12 so that heating element 12 is forced against glass panel 34 with the desired force. Hook portion 46 may be spaced from heating element 12, for example, so that cooling air can flow between hook portion 46 and element 12. An adhesive 52 is shown securing plate 26 to panel 34 and, as explained below, securing plate 26 to panel 34 improves the stability and support of element 12.

Figure 4:
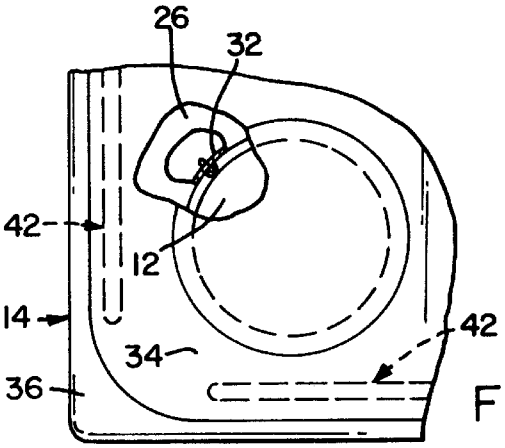
FIG. 4 is a partial top view, with components cut-away, of the range shown in FIG. 1.

FIG. 4 is a partial top view, with components cut-away, of range 10. As shown in FIG. 4, glass panel 34 is secured to plate 26 at various locations 42. By securing plate 26 to glass panel 34, glass panel 34 provides stability and support for heating elements 12. The added stability and support provided by glass panel 34 facilitates maintaining heating elements 12 against glass panel 34 with a desired force, e.g., fourteen pounds.

It also is believed that by securing plate 26 to panel 34, glass panel 34 is subjected to only low stresses, which results in the dome of panel 34 being less than domes associated with known ranges. More particularly, the term "dome" refers to the shape of known glass panels and results in skillets not being able to be entirely level when resting on the glass panel. By lowering the dome of panel 34, skillets and other cooking pots are more level when resting on panel 34, which facilitates maintaining such pots on glass panel 34 while cooking.

With respect to fabrication of plate 26, plate 26 can be fabricated using excess material which results from fabrication of cooktop frame 14. Specifically, to form opening 38 in frame 14, a metal stamping process typically is utilized. By using the metal stamped from frame 14 to form opening 38, a cost savings potentially results since rather than simply discarding such metal, the metal can be used to fabricate plate 26. Of course, plate 26 also could be fabricated from other materials, including even plastic.

In addition, mounting system 16 has a reduced number of parts as compared to known mounting assemblies and is simple to assemble. Further, system 16 substantially eliminates a need for the use of tools to secure heating elements so as to facilitate avoiding scratching glass panel.

Various alternative embodiments of the above described mounting system are possible. For example, rather than plate 26, separate brackets adhesively secured to the glass panel can be used to support the heating elements. The brackets can be fabricated separate from the heating elements, or the brackets can be integral with the heating elements and fabricated as components of such elements.

Figure 5:
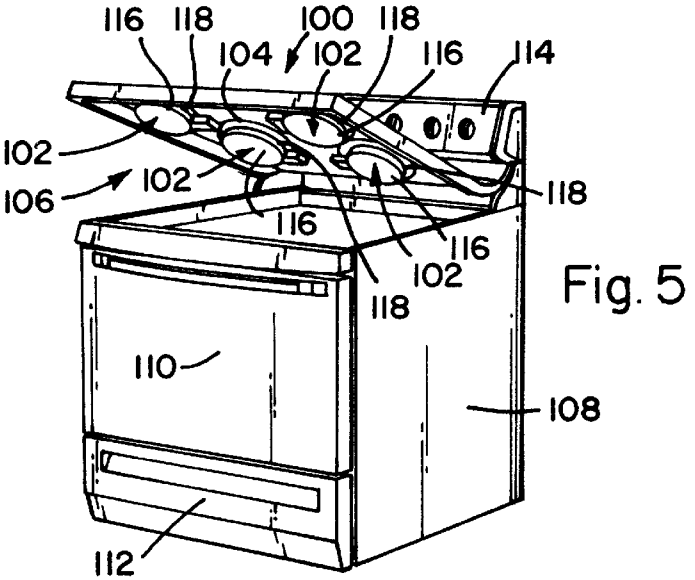
FIG. 5 is a perspective view of a range including radiant heating elements and a mounting system in accordance with another embodiment of the present invention.

More specifically, FIG. 5 is a perspective view of a range 100 including radiant heating elements 102 secured to a glass panel 104 by a mounting system 106 in accordance with another embodiment of the present invention. Range 100 includes a cabinet 108, a door 110 closing an open end of a cooking cavity (not shown) and secured (e.g., by hinges) to cabinet 108, and a lower drawer 112. Range 100 further includes a backsplash 114 extending from cabinet 108. As described hereinafter in more detail, mounting system 106, in one embodiment, includes heater pans 116, which may be integral with respective heating elements 102, having extensions illustrated herein as annular flanges 118 which is adhesively secured to glass panel 104.

Mounting system 106 can be utilized in many different model ranges and is not limited to use in any one particular range. Range 100 is illustrated here by way of example only. Ranges 100 are well known and are commercially available from General Electric Company, Appliance Park, Louisville, Ky. 40225.

Figure 6:
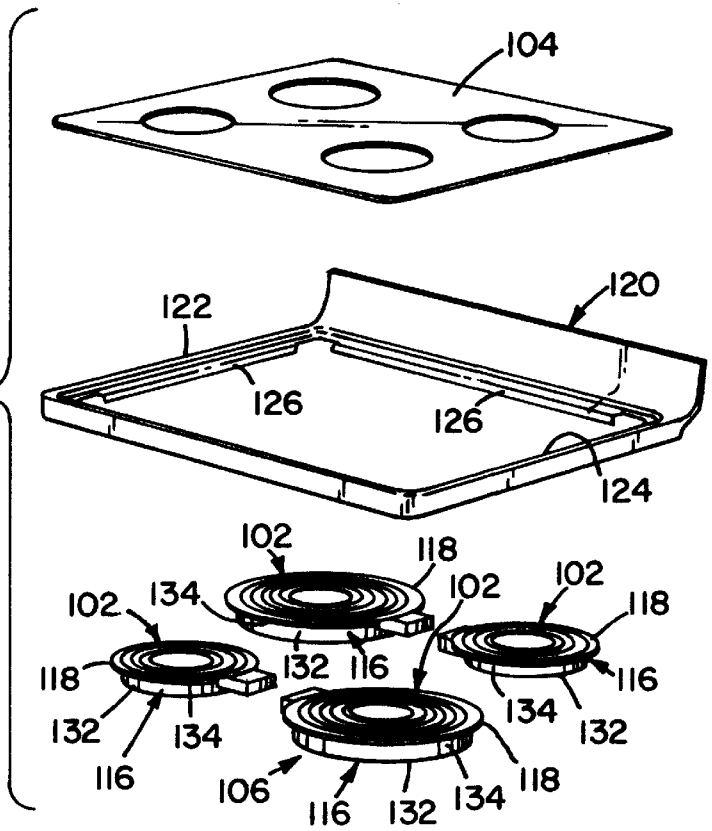
FIG. 6 is an exploded view of the cooktop and heating element assembly shown in FIG. 5.

FIG. 6 is an exploded view of glass panel 104, cooktop 120 and mounting system 106. As shown in FIG. 6, cooktop 120 includes a frame 122 having an opening 124 for receiving glass panel 104. Frame flanges 126 extend into opening 124 and support glass panel 104. Mounting system 106 includes heater pans 116 integral with respective heating elements 102. Each heater pan 116 includes annular flange 118 which is adhesively secured to glass panel 104.

Figure 7:
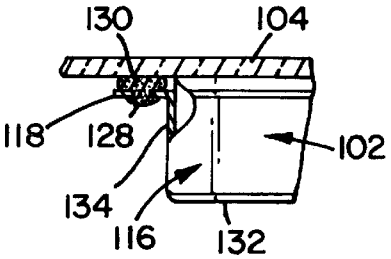
FIG. 7 is an enlarged, partial cross sectional view illustrating the bracket integral with the heating element and adhesive for securing the heating element to the glass panel.

Specifically, and referring to FIG. 7 which is an enlarged, partial cross sectional view illustrating flange 118 and adhesive 128 for securing heating element 102 to glass panel 104, heating element 102 is secured to glass panel 104 using, for example, a silicone adhesive or other adhesive material. A plurality of openings 130 may be provided in respective flanges 118 so that adhesive 128 is located, and cured, on opposing sides of flange 118 to provide additional stability and support. Of course, adhesive 128 may be applied at a plurality of locations along each flange 118 so that heating elements 102 are securely fastened to glass panel 104.

Figure 8:
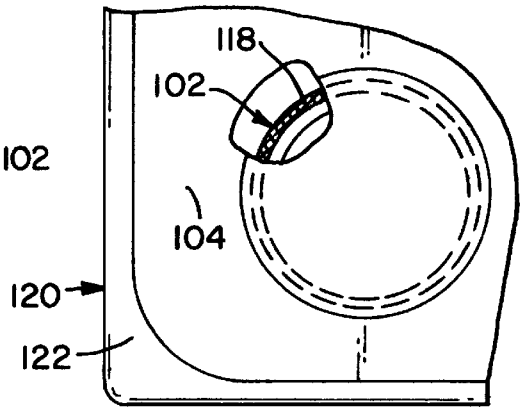
FIG. 8 is a partial top view, with components cut-away, of the range shown in FIG. 5.

FIG. 8 is a partial top view, with components cut-away, of range 100. As shown in FIG. 8, flange 118 is secured directly to glass panel 104. By securing flange 118 directly to glass panel 104, glass panel 104 provides stability and support for heating elements 102. The added stability and support provided by glass panel 104 facilitates maintaining heating elements 102 against glass panel 104 with a desired force, e.g., fourteen pounds and in heat transfer contact.

It also is believed that by securing flanges 118 to glass panel 104, glass panel 104 is subjected to only low stresses, which results in the dome of panel 104 being less than domes associated with known ranges. By lowering the dome of panel 104, skillets and other cooking pots are more level when resting on panel 104, which facilitates maintaining such pots on glass panel 104 while cooking.

With respect to fabrication of pans 116, pans 116 can be fabricated using excess material which results from fabrication of cooktop frame 122. Specifically, to form opening 124 in frame 122, a metal stamping process typically is utilized. By using the metal stamped from frame 122 to form pans 116, a cost savings potentially results since rather than simply discarding such metal, the metal can be used to fabricate pans 116. Pans 116 include extensions (illustrated as flange 118) and a cup-shaped portion having a base 132 and a sidewall 134. Of course, pans 116 also could be fabricated from other materials, including even plastic. In one specific embodiment, pans 116 are fabricated from steel coated with aluminum.

In addition, mounting system 106 has a reduced number of parts as compared to known mounting assemblies and is simple to assemble. Further, system 106 substantially eliminates a need for the use of tools to secure heating elements so as to facilitate avoiding scratching glass panel.

Of course, many alternative configurations of mounting system 106 are contemplated. For example, rather than extensions configured as continuous annular shaped flanges 118, pans 116 can be constructed to have extensions of alternative geometric configurations. Such extensions primarily serve the function of enabling easy attachment of heating elements 102 to glass panel 104. As one example, and rather than flanges 118, the extensions can be in the form of tabs, and the tabs can be adhesively secured to glass panel 104 in the same manner in which flanges 118 are secured to glass panel 104.

From the preceding description of the present invention, it is evident that the objects of the invention are attained. Although the invention has been described and illustrated in detail, it is to be clearly understood that the same is intended by way of illustration and example only and is not be taken by way of limitation. Accordingly, the spirit and scope of the invention are to be limited only by the terms of the appended claims.

What is claimed is:

1. A range comprising:

a cooktop comprising a frame having an opening;

a glass panel located in said opening and supported by said frame;

a plate secured to an underside surface of said glass panel, said plate having at least one radiant heating element opening and a rim extending from an underside surface of said plate surrounding said radiant heating element opening, said rim having at least one slot formed therein;

a radiant heating element; and a mounting system comprising a spring for engaging to said rim and to said radiant heating element for positioning said radiant heating element within said radiant heating element opening, said spring comprising a spring hook portion at least partially inserted into said rim slot.

2. A range in accordance with claim 1 wherein said spring comprises a lead-in portion for engaging to said heating element.

3. A range in accordance with claim 1 wherein said mounting system forces said heating element against an underside surface of said glass panel.

4. A range in accordance with claim 3 wherein a force between said heating element and said glass panel is approximately about fourteen pounds.

5. A range in accordance with claim 3 wherein said plate is adhesively secured to said glass panel.

6. A range in accordance with claim 5 wherein said plate is secured to said glass panel by a silicone adhesive.

7. A range comprising:

a cooktop comprising a frame having an opening;

a glass panel located in said opening and supported by said frame;

a radiant heating element; and a mounting system comprising a pan having at least one extension, said extension adhesively secured to said glass panel for maintaining said radiant heating element in heat transfer contact with said glass panel.

8. A range in accordance with claim 7 wherein said extension comprises an annular flange.

9. A range in accordance with claim 7 wherein said extension comprises at least one tab.

10. A range in accordance with claim 7 wherein said extension is secured to said glass panel by a silicone adhesive.

11. A range in accordance with claim 7 wherein said mounting system forces said heating element against an underside surface of said glass panel.

12. A range in accordance with claim 11 wherein a force between said heating element and said glass panel is approximately about fourteen pounds.

13. A range in accordance with claim 7 wherein said pan is integral with said heating element.

* * * * *